US010858155B1

(12) United States Patent
Caruso

(10) Patent No.: US 10,858,155 B1
(45) Date of Patent: Dec. 8, 2020

(54) MAGNETIC FOOD STORAGE SYSTEM

(71) Applicant: Anthony Caruso, Clearwater Beach, FL (US)

(72) Inventor: Anthony Caruso, Clearwater Beach, FL (US)

( * ) Notice: Subject to any disclaimer, the term of this patent is extended or adjusted under 35 U.S.C. 154(b) by 0 days.

(21) Appl. No.: 16/851,144

(22) Filed: Apr. 17, 2020

(51) Int. Cl.
*B65D 21/032* (2006.01)
*B65D 43/02* (2006.01)
*B65D 41/16* (2006.01)
*B65D 45/22* (2006.01)

(52) U.S. Cl.
CPC ..... *B65D 43/0212* (2013.01); *B65D 41/16* (2013.01); *B65D 45/22* (2013.01); *B65D 2313/04* (2013.01); *B65D 2543/00027* (2013.01)

(58) Field of Classification Search
CPC ..... B65D 2313/04; B65D 43/0212; B65D 41/16; B65D 45/22; B65D 2543/00027
USPC ..... 220/23.83, 230; 206/818
See application file for complete search history.

(56) References Cited

U.S. PATENT DOCUMENTS 6,831,541 B1 * 12/2004 Seidler ..... A45D 33/006 206/818
2014/0069915 A1 * 3/2014 Reyes ..... B65D 21/023 220/23.83
2014/0251867 A1 * 9/2014 Castaneda ..... B65D 81/022 206/588

* cited by examiner

*Primary Examiner* — King M Chu
(74) *Attorney, Agent, or Firm* — Larson & Larson, P.A.; Justin P. Miller; Frank Liebenow

(57) ABSTRACT

The magnetic food storage is formed from a container and a lid, each with one or more embedded magnets. The magnets interact with each other to hold the containers to each other, hold lids to containers, and hold lids to lids. The magnets are preferably molded inside of the lid and inside the container, the magnets being surrounded by material. This avoids any contact between stored food and the magnets, thus preventing contamination.

14 Claims, 10 Drawing Sheets

MAGNETIC FOOD STORAGE SYSTEM

FIELD

This invention relates to the field of food storage and more particularly to a system of containers with integral magnets.

BACKGROUND

Food storage is an issue that affects everyone. Whether in a restaurant or home setting, storing raw ingredients or prepared foods is a daily task.

Food storage containers come in all shapes, both within a given brand and between brands. The resulting issue is keeping matching lids and containers together.

What is needed is a system of food storage containers that maintains matching containers and lids together.

SUMMARY

The magnetic food storage system is formed from a container and a lid, each with one or more embedded magnets. The magnets interact with each other to hold the containers to each other, hold lids to containers, and hold lids to lids.

The magnets are preferably molded inside of the lid and inside the bottom of the container, the magnets being surrounded by material. Stated differently, there is a pocket within the body of the lid and a pocket within the bottom of the container, creating a space for the magnets. By surrounding the magnets with material, contact between stored food and the magnets is avoided, thus preventing contamination.

Magnets have a polarity, where unlike poles attract and like poles repel. Thus, North attracts South, South attracts North, North repels North, and South repels South.

In some embodiments, the containers have magnetic arrangements that vary depending on the shape of the container. For example, two magnets set in a line for a rectangular container, or three magnets set in a triangle for a round container.

In other embodiments, containers of differing shape have matching magnetic configurations to allow the differing shapes to be stored together. For example, each container and lid using two equally-spaced magnets, allowing smaller containers to be stored within larger containers.

The preferred embodiment is two magnets set in a line, two being a sufficient number to align a container and a lid.

In additional alternative embodiments, the poles of the magnet are used to aid in arrangement of the lids and containers. For example, two magnets set in a line, a first magnet with the N-pole facing into the container, the second magnet with the S-pole facing into the container. If the lid was rotated with respect to its correct position, the like-poles would repel each other, forcing rotation of the lid with respect to the container to match the magnets.

In an additional alternative embodiment, the lid magnet or the container magnet is replaced with a ferromagnet material, such as steel. This substitution of material still allows for attracting between a lid and a container, but the item without the magnet would have no attraction. For example, the lids with embedded steel would not be attracted to each other.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
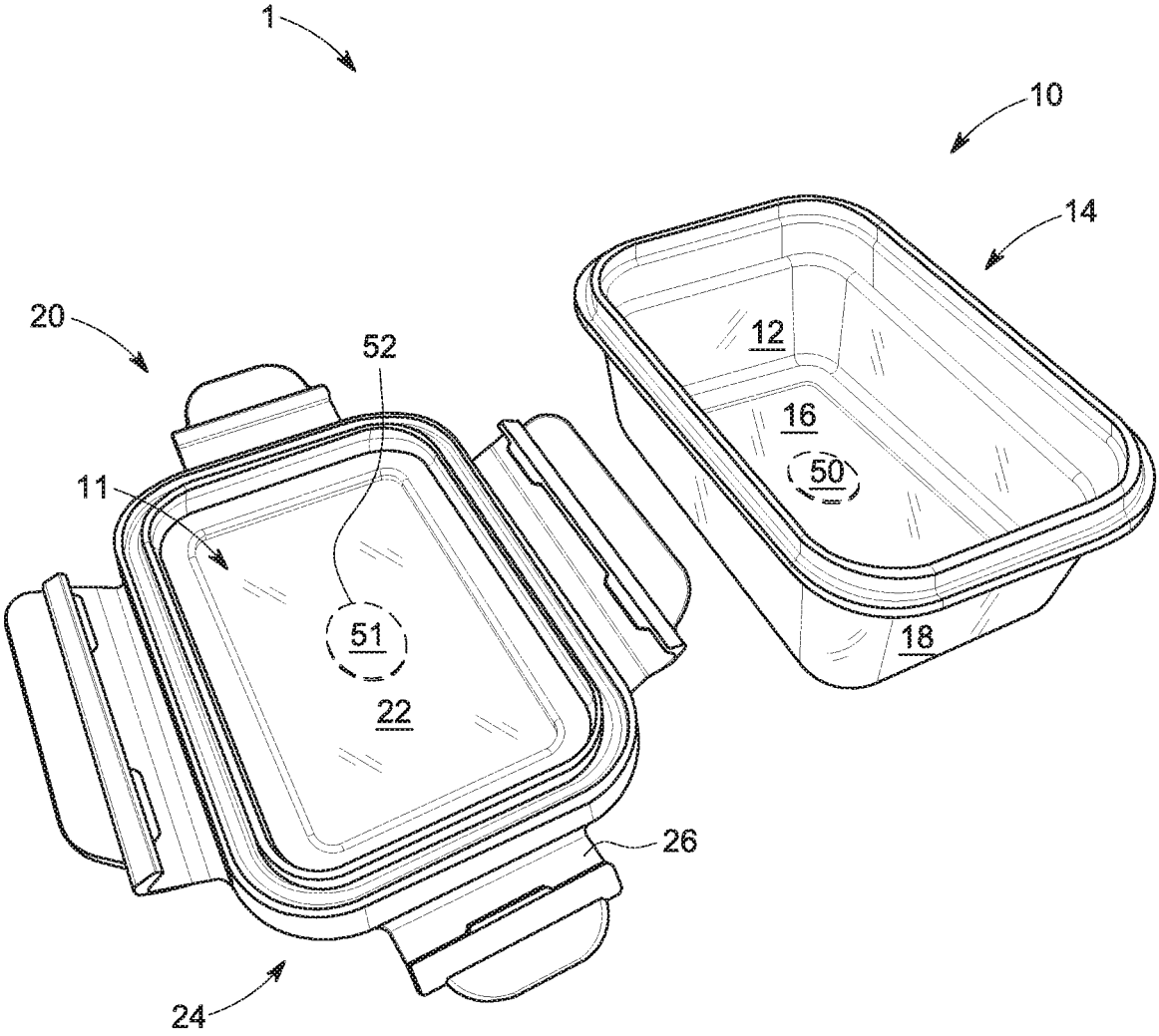
FIG. 1 illustrates a first disassembled view of the magnetic food storage.

Reference will now be made in detail to the presently preferred embodiments of the invention, examples of which are illustrated in the accompanying drawings. Throughout the following detailed description, the same reference numerals refer to the same elements in all figures.

Figure 2:
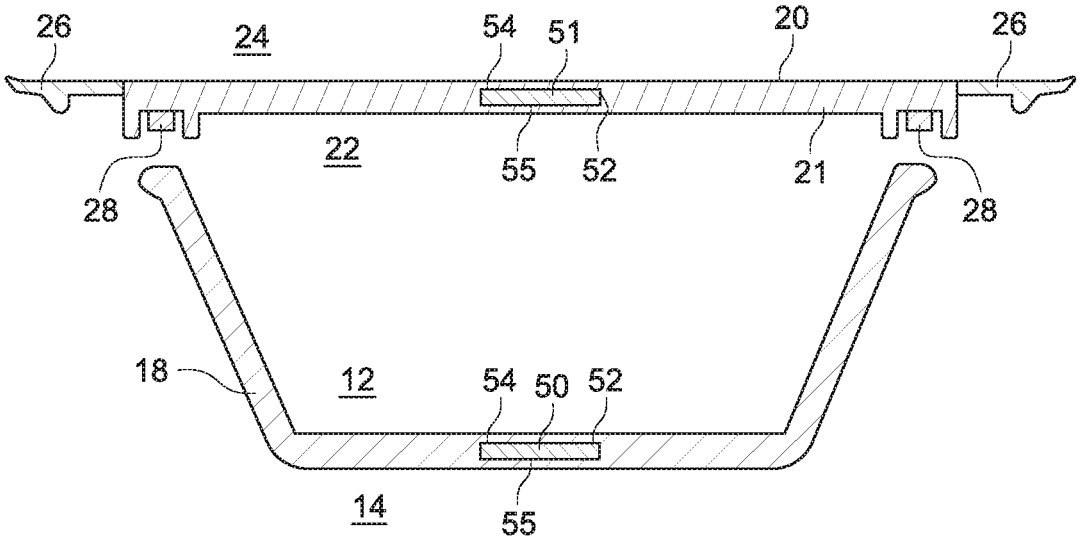
FIG. 2 illustrates a cross-sectional view of the magnetic food storage.

Referring to FIGS. 1 and 2, a first disassembled view and a cross-sectional view of the magnetic food storage are shown.

The magnetic food storage 1 is formed from a container 10 and lid 20.

The container 10 includes an interior 12, exterior 14, bottom 16, and walls 18.

The lid 20 includes an inside 22 and outside 24. The body 21 is affixed to multiple optional locking arms 26. An optional resilient seal 28 compresses during application of the lid 20 to the container 10, improving the seal.

The container 10 includes a container magnet 50, the lid 20 includes a lid magnet 51. The magnets 50/51 are preferably embedded within the container 10 and lid 20 within magnet pockets 52.

The magnets 50/51 have a polarity, with North pole 54 and South pole 55.

Figure 3:
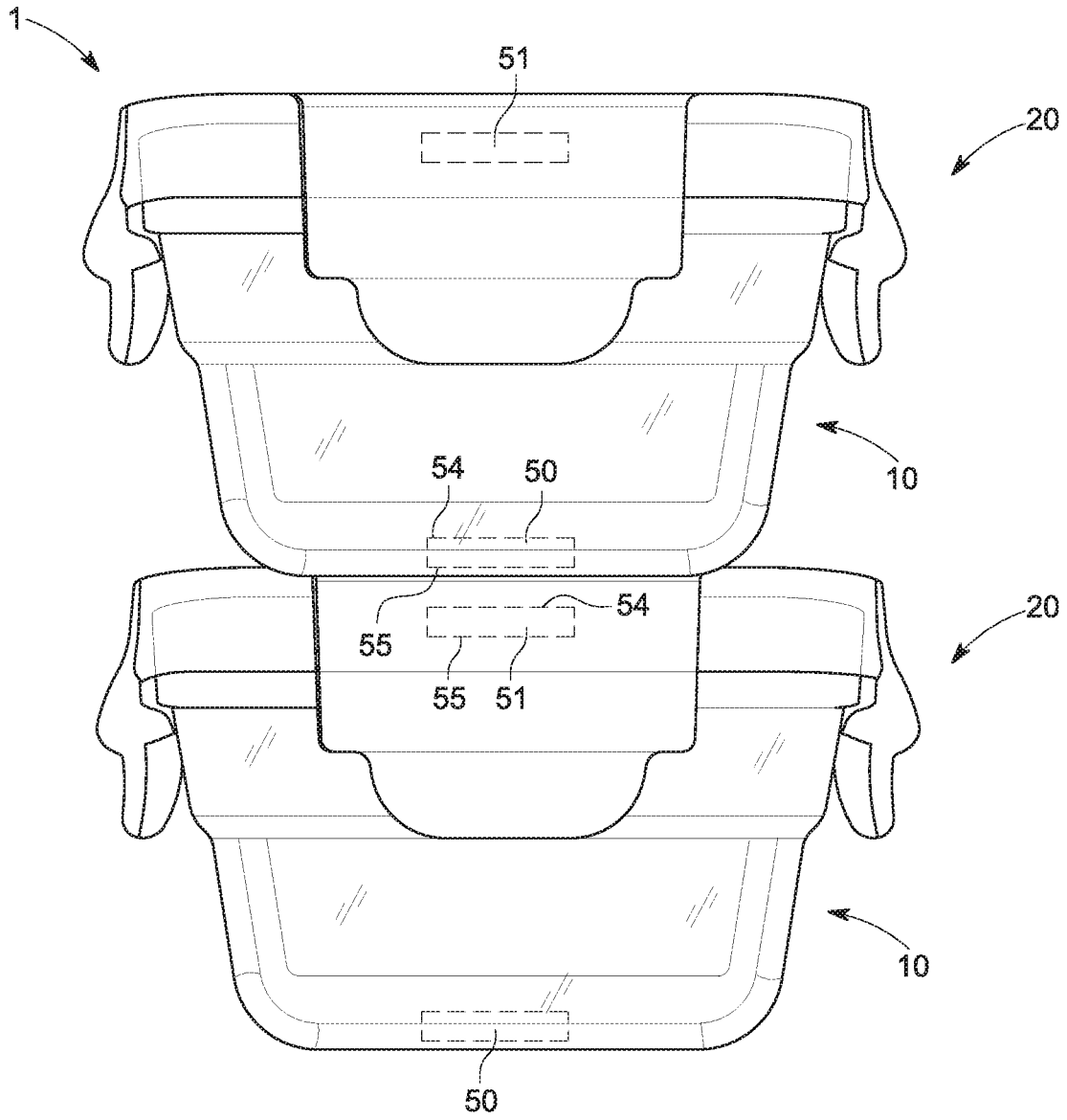
FIG. 3 illustrates a first assembled and stacked view of the magnetic food storage.

Referring to FIG. 3, a first assembled and stacked view of the magnetic food storage is shown.

A first container 10 with lid 20 is placed on top of a second container 10 with lid 20, the container magnet 50 and lid magnet 51 interacting to hold the magnetic food storage 1 together.

Specifically, the North pole 54 of the lid magnet 51 is attracted to the South pole 55 of the container magnet 50.

Figure 4:
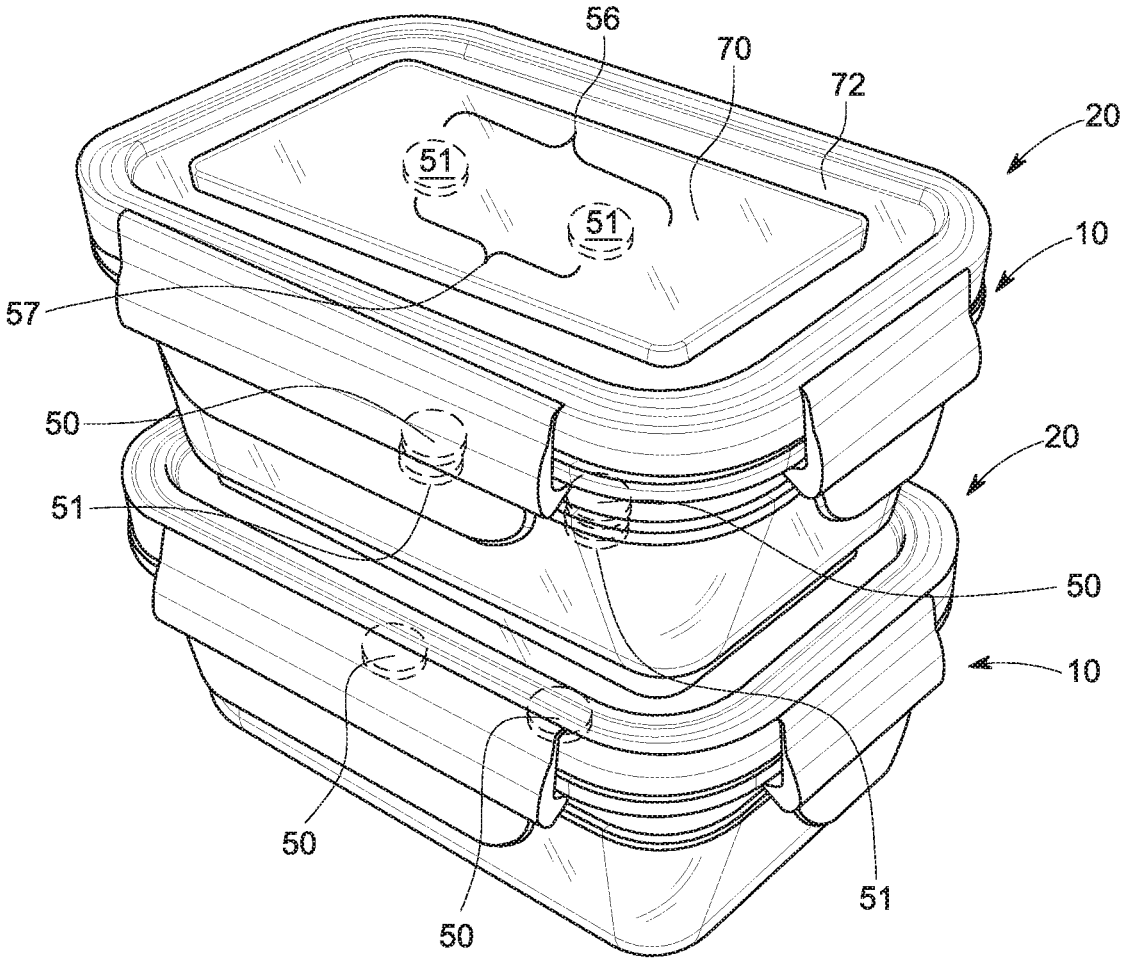
FIG. 4 illustrates a second assembled and stacked view of the magnetic food storage.

Referring to FIG. 4, a second assembled and stacked view of the magnetic food storage is shown.

Again shown is a first container 10 with lid 20 is placed on top of a second container 10 with lid 20, but now the container magnet 50 and lid magnet 51 are set in a magnet pattern 56, the magnets 50/51 separated, the center-to-center distance being the magnet spacing 57. The result is that the first container and second container align, and if placed at an angle with respect to others, the magnets 50/51 will pull the containers into alignment.

Again shown is a first container 10 with lid 20 is placed on top of a second container 10 with lid 20, but now the container magnet 50 and lid magnet 51 are set in a magnet pattern 56, the magnets 50/51 separated, the center-to-center distance being the magnet spacing 57. The result is that the first container and second container align, and if placed at an angle with respect to others, the magnets 50/51 will pull the containers into alignment.

Further shown is protrusion 70 and gap 72.

Figure 5:
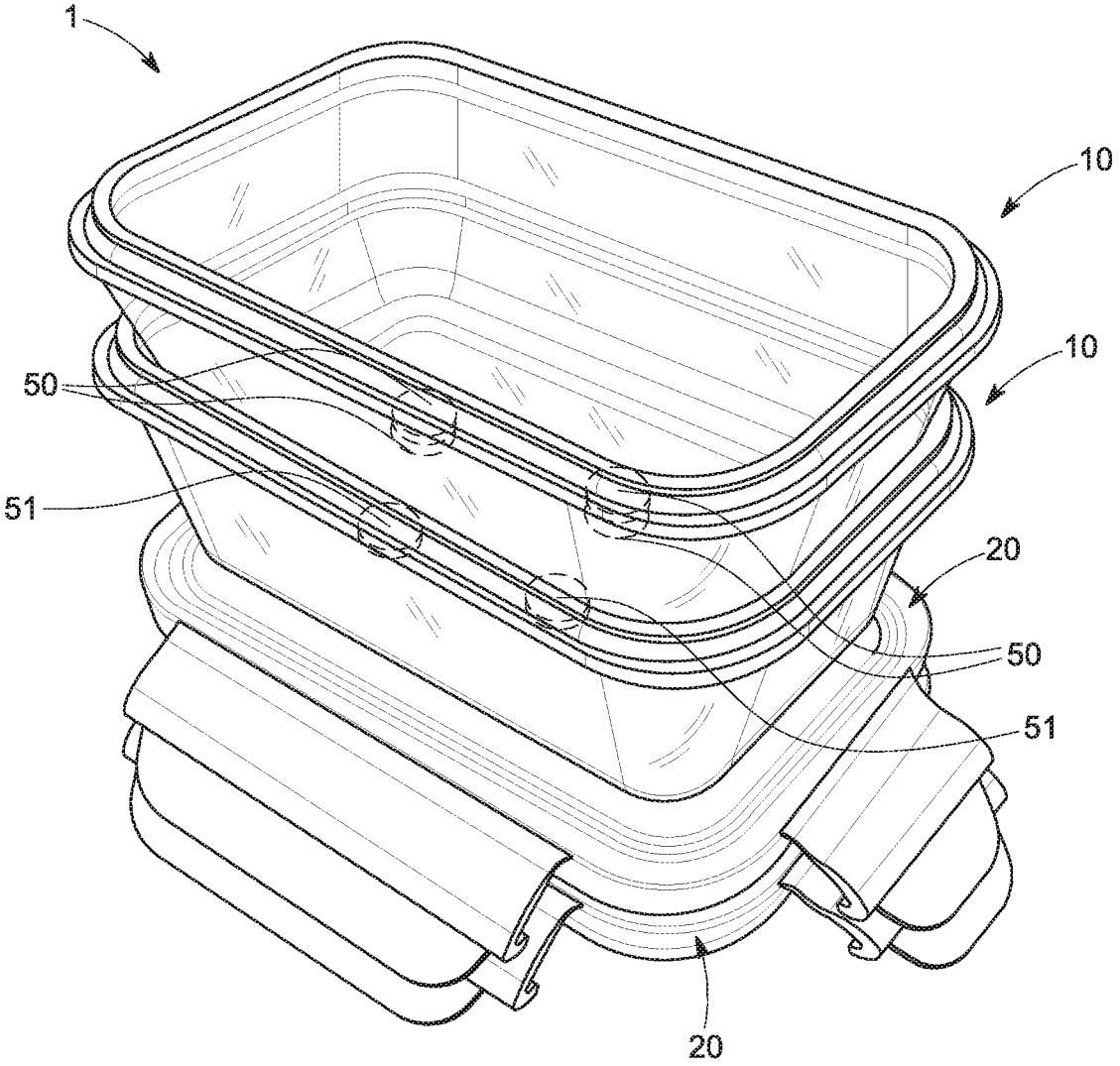
FIG. 5 illustrates a first disassembled and stacked view of the magnetic food storage.

Referring to FIG. 5, a first disassembled and stacked view of the magnetic food storage is shown Referring to FIG. 5, a first disassembled and stacked view of the magnetic food storage is shown.

In this orientation, multiple containers 10 are nested, then set on top of stacked lids 20.

Sets of container magnets 50 are attracted to each other, holding the containers 10 in a nested position. The container magnets 50 are also attracted to the lid magnets 51, the lid magnets 51 in turn attracted to each other.

The result is a stack of containers 10 and lids 20 that stay together.

Figure 6:
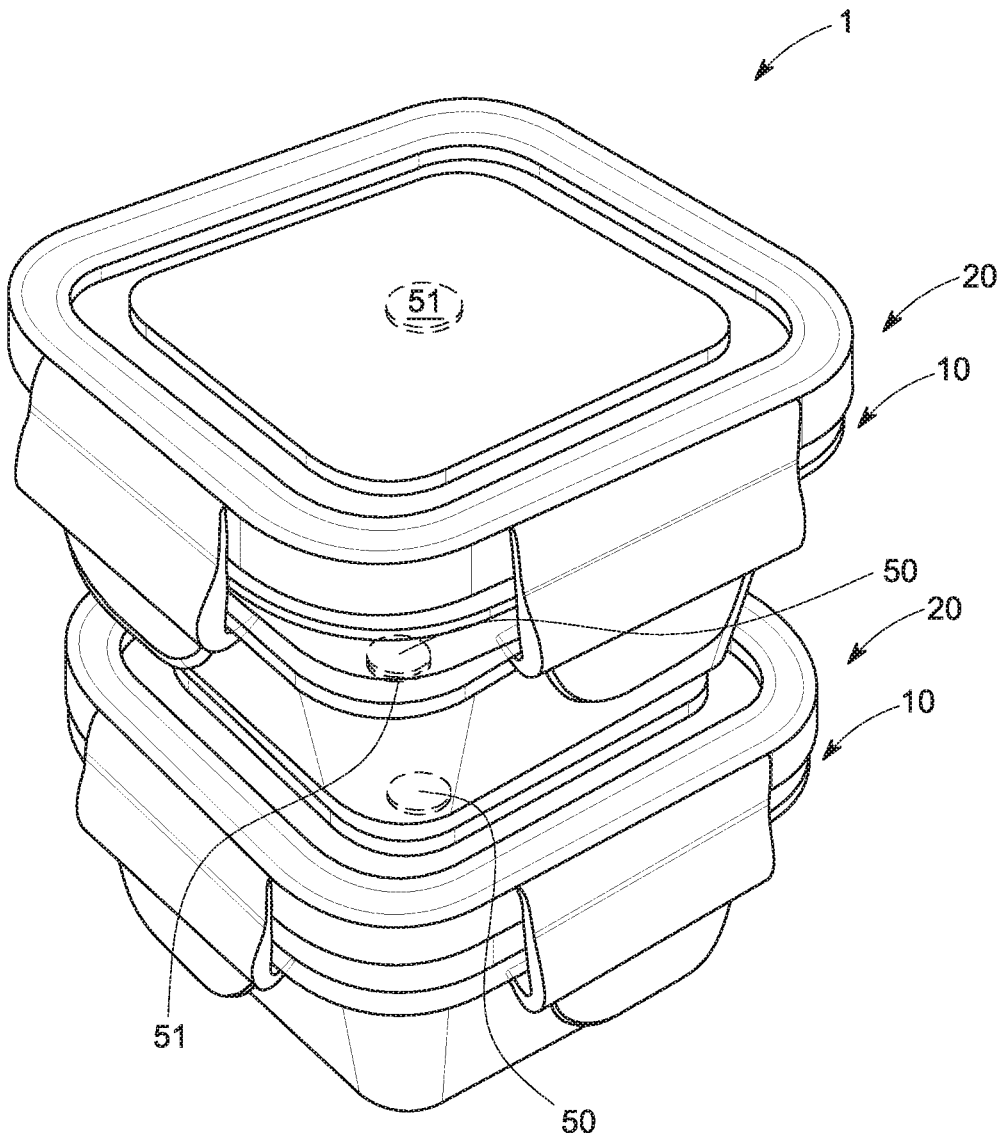
FIG. 6 illustrates a third assembled and stacked view of the magnetic food storage.
Figure 7:
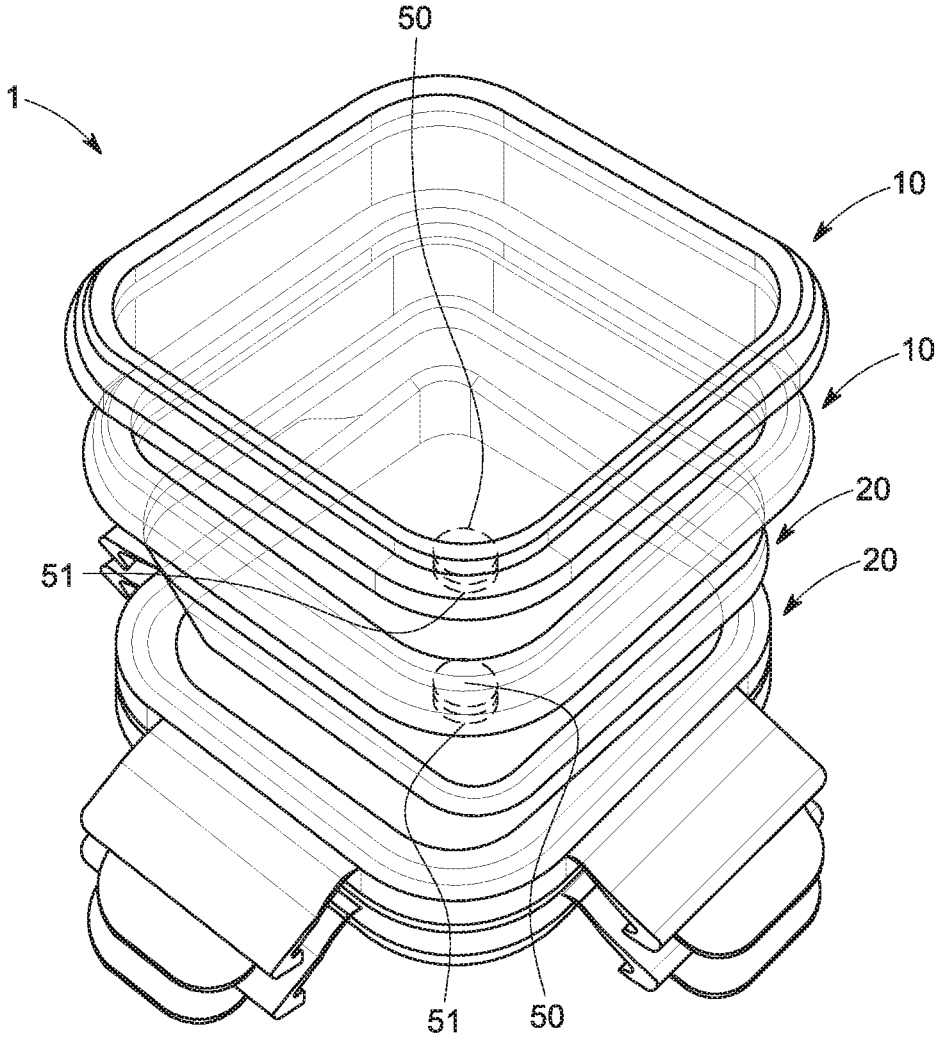
FIG. 7 illustrates a second disassembled and stacked view of the magnetic food storage.

Referring to FIGS. 6 and 7, a third assembled and stacked view and a second disassembled and stacked view of the magnetic food storage are shown. Similarly to FIGS. 4 and 5, the container magnets 50 and lid magnets 51 operate to keep the magnetic food storage 1 stacked when closed, as well as when open. The result is that the magnetic food storage 1 stays together when closed and open.

Referring to FIG. 8, a view of lids of differing magnetic arrangements of the magnetic food storage is shown.

Each embodiment of the lid 20 is shown with a differing magnet pattern 56.

Figure 8A:
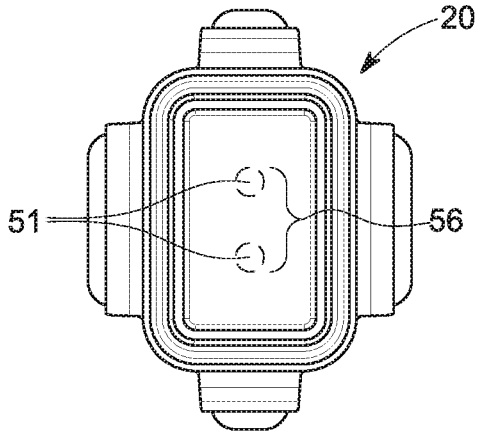
FIGS. 8A-8D illustrate a view of lids of differing magnetic arrangements of the magnetic food storage.

FIG. 8A shows two lid magnets 51 in a linear arrangement.

Figure 8B:
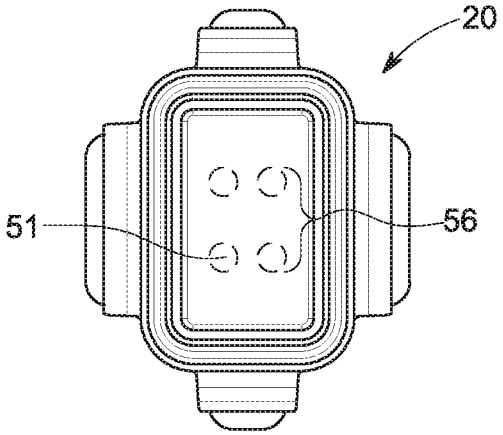

FIG. 8B shows four lid magnets 51 in a square pattern.

Figure 8C:
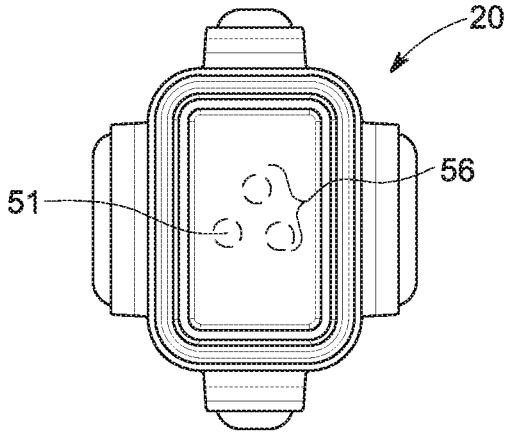

FIG. 8C shows three lid magnets 51 in a triangular pattern.

Figure 8D:
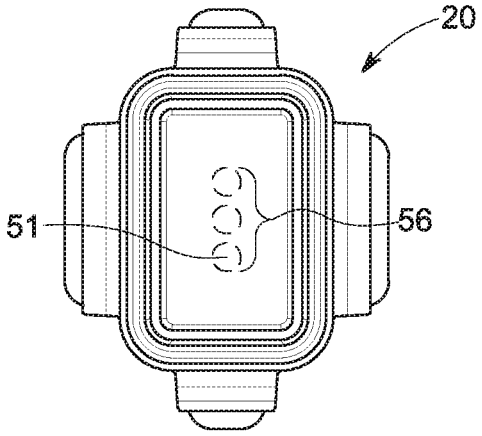

FIG. 8D shows three lid magnets 51 in a linear arrangement.

These differing magnet patterns 56 have different purposes. The position of the magnets 50/51 affect at which positions the containers 10 and lids 20 will attract each other. Linear arrangements have two positions—0 and 180 degrees. Triangular arrangements have three positions—0, 120, and 240 degrees. Square arrangements have four positions—0, 90, 180, and 270.

As a means of reducing positions at which containers 10 and lids 20 will lock, the lid magnets 51 can be inverted, such that the poles face different directions.

For example, for FIG. 8A, by arranging lid magnets 51 such that the North pole 54 (see FIG. 2) of one lid magnet 51 faces up, and the South pole 55 (see FIG. 2) of the other lid magnet 51 faces up, rather than having two possible orientations—0 and 180 degrees—only one orientation remains—0 degrees.

In such an embodiment, the container magnets 50 are similarly flipped, matching the orientation of their corresponding lid magnets 51.

Similar reorientation of the magnets for other magnet patterns 56 correspondingly affects the number of positions at which containers 10 and lids 20 will interface.

Figure 9:
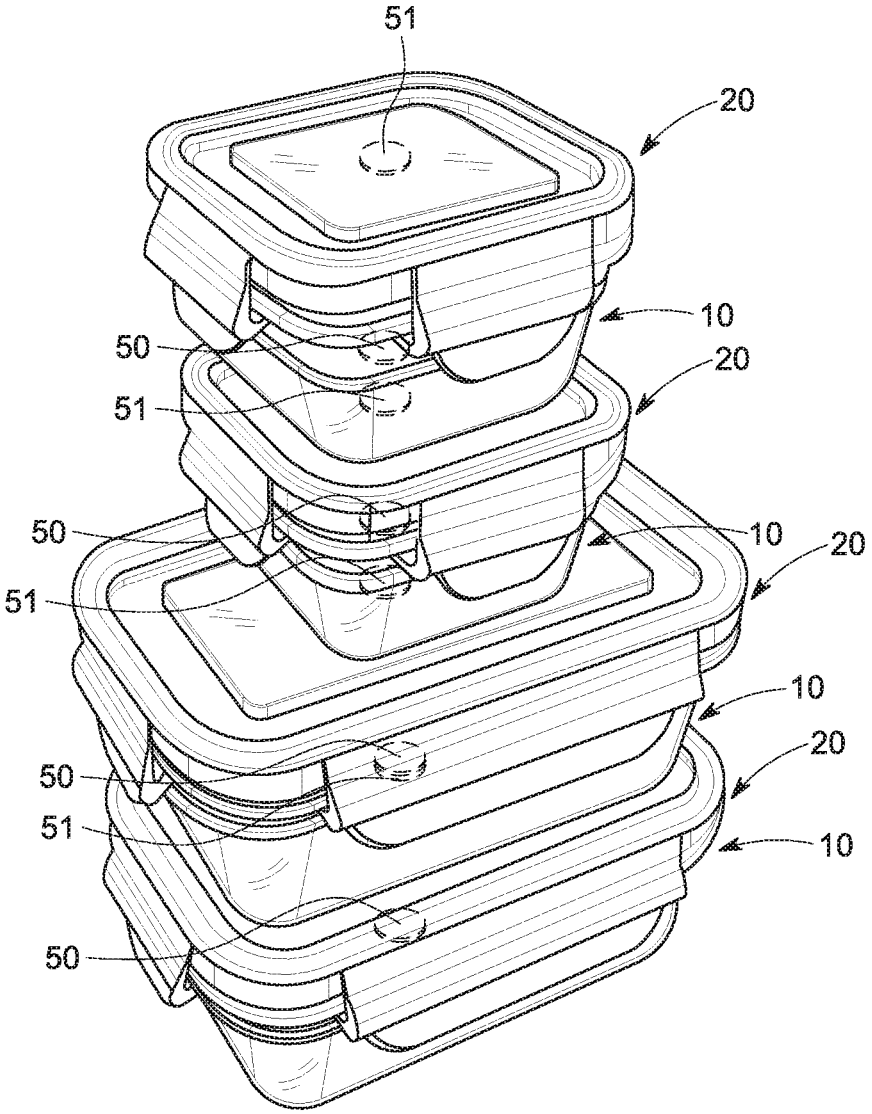
FIG. 9 illustrates a first stacked view showing different container shapes of the magnetic food storage.

Referring to FIG. 9, a first stacked view showing different container shapes of the magnetic food storage is shown.

In this embodiment, the magnetic food storage 1 is shown in both square and rectangular shapes. The square and rectangular shapes are all shown with magnet patterns 56 using only a single container magnet 50 and lid magnet 51.

Thus, the square containers and rectangular containers line up.

Figure 10:
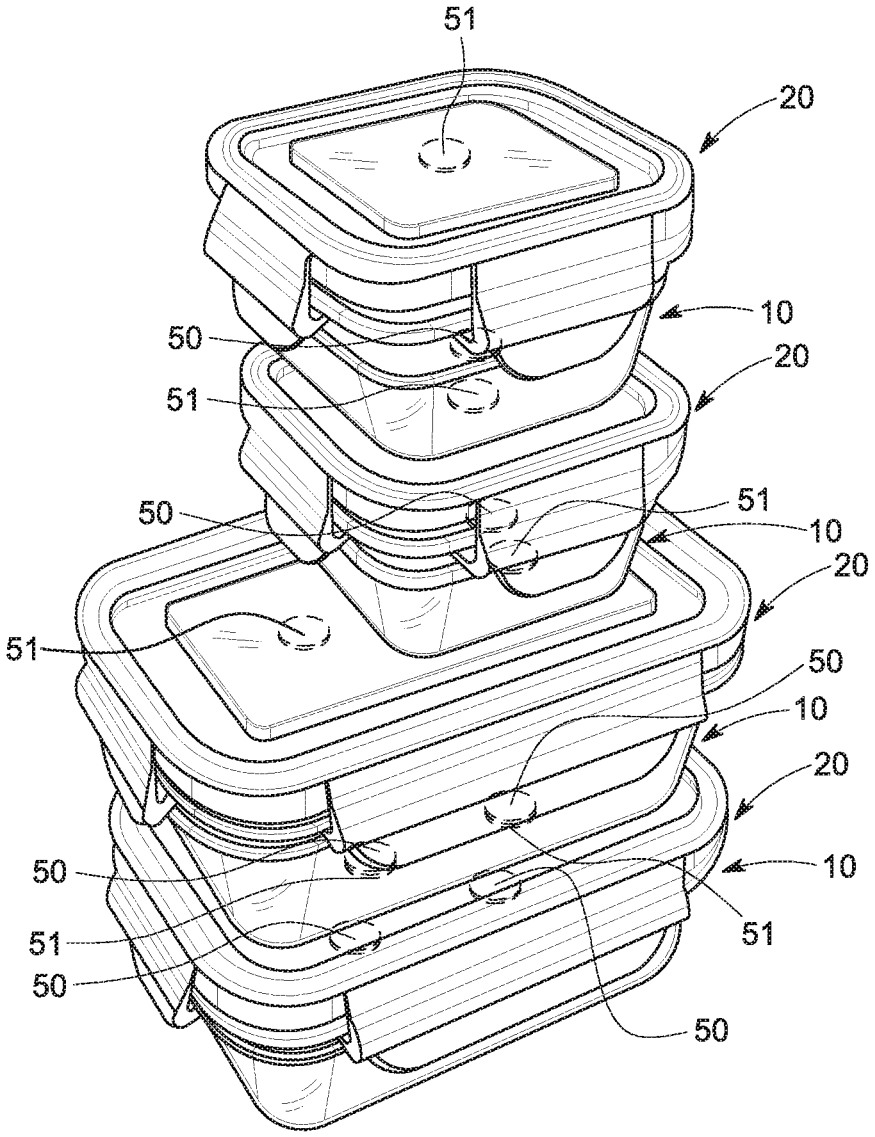
FIG. 10 illustrates a second stacked view showing different container shapes of the magnetic food storage.

Referring to FIG. 10, a second stacked view showing different container shapes of the magnetic food storage is shown.

In this embodiment, the magnetic food storage 1 is again shown in both square and rectangular shapes. But the square and rectangular shapes use differing magnet patterns 56. The square containers use only a single container magnet 50 and lid magnet 51, whereas the rectangular containers use a magnet pattern 56 with two container magnets 50 and lid magnets 51 per container 10 and lid 20.

Thus, the containers 10 and lids 20 still interface, but are offset.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A food storage system comprising:

a food container;

a container magnet within the food container;

the food container having a top and a bottom;

the top including a protrusion;

the food container tapering from the top toward the bottom, thus permitting the food container to fit within a second food container;

a lid configured to fit the food container;

a lid magnet within the protrusion of the lid;

the lid fully detachable from the food container;

whereby the container magnet and the lid magnet attract each other, maintaining the food container with the lid.

2. The food storage system of claim 1, wherein:

the container magnet is embedded within the bottom of the food container; and the lid magnet is embedded within a body of the lid;

whereby when food is placed within the food storage system, it cannot contact the container magnet or lid magnet.

3. The food storage system of claim 1 wherein:

the container magnet is two container magnets; and the lid magnet is two lid magnets;

whereby the orientation of the two container magnets and the two lid magnets aligns the food container with respect to the lid for storage.

4. The food storage system of claim 1, further comprising:

a second container magnet within the bottom of the container;

a second lid magnet within the body of the lid;

whereby for storage, the first container magnet attracts the first lid magnet, and the second container magnet attracts the second lid magnet, holding the lid to the container.

5. The magnetic food storage system of claim 4, wherein the first container magnet and the second container magnet are oriented with matching polarity, such as both N-poles facing toward an interior of the container.

6. The magnetic food storage system of claim 4, wherein the first container magnet and the second container magnet are oriented with opposite polarity, such as one N-pole facing toward an interior of the container and one S-pole facing toward the interior of the container.

7. A magnetic food storage system comprising:

a container;

the container formed from a bottom, a top, and four or more walls;

the top being larger than the bottom, thus permitting the container to fit within a second container;

a first container magnet within the bottom of the container;

a lid;

the lid formed from a body;

the lid separable from the container;

the lid including a protrusion;

a first lid magnet within the protrusion of the lid;

whereby the container magnet is attracted to the lid magnet, thus causing the container and lid to remain together as pair.

8. The magnetic food storage system of claim 7, further comprising:

a second container magnet within the bottom of the container;

a second lid magnet within the body of the lid;

whereby for storage, the first container magnet attracts the first lid magnet, and the second container magnet attracts the second lid magnet, holding the lid to the container.

9. The magnetic food storage system of claim 8, wherein the first container magnet and the second container magnet are oriented with matching polarity, such as both N-poles facing toward an interior of the container.

10. The magnetic food storage system of claim 8, wherein the first container magnet and the second container magnet are oriented with opposite polarity, such as one N-pole facing toward an interior of the container and one S-pole facing toward the interior of the container.

11. A food storage system using embedded magnets to aid in the storage of components, the food storage system comprising:

a storage container;

a first pair of magnets set within a base of the storage container;

the storage container including an open top;

the storage container tapering from the open top toward the bottom, thus permitting the storage container to fit within a second storage container;

a lid adapted to fit the storage container;

the lid including a protrusion;

a second pair of magnets within the protrusion of the lid;

the lid separable from the food container;

whereby the first pair of magnets and the second pair of magnets are attracted, thus holding the storage container to prevent loss.

12. The food storage system of claim 11, wherein:

the first pair of magnets is fully surrounded by material forming the base of the storage container;

the second pair of magnets is fully surrounded by material forming the body of the lid;

whereby when food is placed within the food storage system, it cannot contact the container magnet or lid magnet.

13. The food storage system of claim 12, wherein the magnets of the first pair of magnets are oriented with matching polarity, such as both N-poles facing toward an interior of the storage container.

14. The food storage system of claim 12, wherein the magnets of the first pair of magnets are oriented with opposing polarity, such as one N-pole facing toward an interior of the storage container and one S-pole facing toward the interior of the storage container.

* * * * *